US011589728B2

(12) United States Patent
Watzenegger et al.

(10) Patent No.: US 11,589,728 B2
(45) Date of Patent: Feb. 28, 2023

(54) DISH RACK FOR DISHWASHERS

(71) Applicant: FRIES Planungs-und Marketinggesellschaft m.b.H., Sulz (AT)

(72) Inventors: Tobias Watzenegger, Weiler (AT); Markus Grabher, Lustenau (AT)

(73) Assignee: FRIES Planungs—und Marketinggesellschaft m.b.H., Sulz (AT)

( * ) Notice: Subject to any disclaimer, the term of this patent is extended or adjusted under 35 U.S.C. 154(b) by 241 days.

(21) Appl. No.: 16/891,282

(22) Filed: Jun. 3, 2020

(65) Prior Publication Data

US 2020/0375432 A1 Dec. 3, 2020

(30) Foreign Application Priority Data

Jun. 3, 2019 (AT) ..... A 210/2019

(51) Int. Cl.
*A47L 15/50* (2006.01)
*A47L 15/42* (2006.01)

(52) U.S. Cl.
CPC ..... *A47L 15/50* (2013.01); *A47L 15/501* (2013.01); *A47L 15/428* (2013.01)

(58) Field of Classification Search
CPC ..... A47L 15/428; A47L 15/501; A47L 15/50
See application file for complete search history.

(56) References Cited

U.S. PATENT DOCUMENTS

| | | | | |
|---|---|---|---|---|
| 3,266,632 | A * | 8/1966 | Maslow | A47L 15/501 211/41.8 |
| 3,584,744 | A | 6/1971 | Ettlinger, Jr. | |
| 6,186,328 | B1 | 2/2001 | Apps | |
| 2014/0021153 | A1 | 1/2014 | Jensen et al. | |
| 2020/0375431 | A1* | 12/2020 | Watzenegger | A47L 15/501 |

FOREIGN PATENT DOCUMENTS

| | | | | |
|---|---|---|---|---|
| AT | 507308 | | 8/2010 | |
| AT | 12122 | | 11/2011 | |
| CN | 107212829 | | 9/2017 | |
| DE | 112004000238 | | 5/2012 | |
| EP | 1287780 | | 3/2003 | |
| EP | 1287780 | A2 * | 3/2003 | A47L 15/501 |
| EP | 1413242 | | 4/2004 | |
| EP | 3357400 | | 8/2018 | |
| KR | 101147471 | B1 * | 5/2012 | A47L 15/501 |

* cited by examiner

*Primary Examiner* — Kimberley S Wright
(74) *Attorney, Agent, or Firm* — Volpe Koenig

(57) ABSTRACT

A dish rack for dishwashers, with side walls and a grid-shaped rack base together surrounding a rack interior space of the dish rack, and the rack base and/or the side walls having standing surfaces that end in a standing plane of the dish rack. In at least one of the side walls at least one washing liquid deflecting surface is formed for deflecting a washing liquid jet, which penetrates the standing plane, into the rack interior space. The washing liquid deflecting surface extends between inner and outer wall portions of the side wall. The washing liquid deflecting surface has at least one deflecting surface region which, as seen in a sectional plane parallel to the standing plane, is arranged at an obtuse angle relative to an inner surface of the inner wall portion, this inner surface facing the rack interior space, and the deflecting surface region has a height extent of at least 5 mm in a vertical direction normal to the standing plane.

15 Claims, 11 Drawing Sheets

DISH RACK FOR DISHWASHERS

INCORPORATION BY REFERENCE

The following documents are incorporated herein by reference as if fully set forth: Austrian patent application no. A 210/2019, filed Jun. 3, 2019.

TECHNICAL FIELD

The present invention relates to a dish rack for dishwashers, the dish rack having a grid-shaped rack base and side walls, and the side walls together with the grid-shaped rack base surrounding a rack interior space of the dish rack, and the rack base and/or the side walls having standing surfaces on an underside of the dish rack, said standing surfaces ending in a standing plane of the dish rack, wherein in at least one of the side walls at least one washing liquid deflecting surface for deflecting a washing liquid jet, which penetrates the standing plane, into the rack interior space is formed, and the washing liquid deflecting surface extending between an inner wall portion of the side wall and an outer wall portion of the side wall, and the outer wall portion being arranged further on the outside, as seen from the rack interior space, than the inner wall portion.

Furthermore, the invention also relates to an arrangement comprising a dishwasher and a dish rack, and to a method for washing objects in a dishwasher, said objects being arranged in the rack interior space of a dish rack.

BACKGROUND

In the prior art, dish racks of the type in question are used for washing crockery, glasses, cutlery and the like in dishwashers. Especially in the industrial sector, such dish racks can also be used for washing other objects in dishwashers.

A dish rack of the type mentioned is disclosed, for example, in EP 1 287 780 B1. In said dish rack, the washing liquid deflecting surfaces are in the form of strips running parallel to the standing plane.

SUMMARY

It is the object of the invention to improve dish racks of the type in question to the effect that they contribute to as good a washing result as possible.

According to the invention, it is provided for this purpose that the washing liquid deflecting surface has at least one deflecting surface region which, as seen in a sectional plane parallel to the standing plane, is arranged at an obtuse angle relative to an inner surface of the inner wall portion, said inner surface facing the rack interior space, wherein said deflecting surface region in a vertical direction normally to the standing plane has a height extent of at least 5 mm, preferably of at least 10 mm.

While the washing liquid deflecting surfaces in the abovementioned prior art are always arranged parallel to the standing plane, embodiments according to the invention make provision for the washing liquid deflecting surface to have at least one deflecting surface region which, as seen in the sectional plane parallel to the standing plane, is arranged at an obtuse angle relative to the inner surface of the inner wall portion, said inner surface facing the rack interior space. In order to be able to effectively act here as a deflecting surface, it is provided that said deflecting surface region in the vertical direction normally to the standing plane has at least the abovementioned height extent.

The term the inner surface should be understood here within the context of an inner surface which is the surface facing the rack interior space.

The effect achieved by the invention is that the washing liquid entering the side wall is deflected in the manner of a 3D effect at the washing liquid deflecting surfaces according to the invention, and therefore the objects which are to be washed and are located in the rack interior space are acted upon with washing liquid from as many different sides as possible. This makes it possible to at least substantially avoid there being regions of the objects to be washed that are not acted upon with washing liquid. Overall, the washing result is therefore significantly improved over the prior art by said washing liquid deflecting surfaces designed according to the invention. As a rule, a plurality of washing liquid deflecting surfaces according to the invention having corresponding deflecting surface regions which, as seen in the sectional plane parallel to the standing plane, are arranged at an obtuse angle relative to the inner surface of the inner wall portion, said inner surface facing the rack interior space, are arranged in a side wall. The respective deflecting surface region and the inner surface of the inner wall portion that is directly adjacent thereto should always be considered as being at said angles. The obtuse angles mentioned are advantageously within a range of 91° to 160°, preferably of 95° to 140°.

Within the context of the mentioned effect of the spatial deflection in as many different directions as possible, in preferred embodiments of the invention it is provided that the deflecting surface region which, as seen in the sectional plane parallel to the standing plane, is arranged at the obtuse angle relative to the inner surface of the inner wall portion, said inner surface facing the rack interior space, additionally, as seen in a sectional plane orthogonal to the standing plane, encloses an acute angle with the standing plane.

In addition, the washing liquid deflecting surfaces may, however, also have deflecting surface regions which, as seen in a sectional plane orthogonal to the standing plane, enclose only an acute angle with the standing plane. The last-mentioned deflecting surface regions of the washing liquid deflecting surface are then therefore oriented in the manner as is known per se in the prior art mentioned at the beginning.

The deflecting surface regions according to the invention can be inherently flat, or else inherently curved. Since the deflecting surface regions can deploy a corresponding effect, it is advantageously provided that the deflecting surface region, as seen in the sectional plane parallel to the standing plane, between the inner surface of the inner wall portion and an inner surface of the outer wall portion, said inner surface facing the rack interior space, has an extent of at least 5 mm, preferably of at least 10 mm, as measured along the deflecting surface region.

It is preferably also provided that, as seen in the sectional plane parallel to the standing plane, two of the deflecting surface regions of the washing liquid deflecting surface, which deflecting surface regions are arranged at the obtuse angle relative to an inner surface of the inner wall portion, said inner surface facing the rack interior space, jointly and directly adjoin the outer wall portion on mutually opposite sides.

Particularly preferred variants make provision here for said two deflecting surface regions, or at least imaginary extensions thereof, to intersect in the outer wall portion or outside the dish rack, as seen in the sectional plane parallel to the standing plane. This particularly simply ensures that the washing liquid jets reflected at the deflecting surface regions are reflected into the rack interior space.

Particularly preferred variants of the invention provide that the washing liquid deflecting surface together with an or the inner surface of the outer wall portion, said inner surface facing the rack interior space, delimit an indentation in the side wall, said indentation being open in the direction toward the standing plane and in the direction toward the rack interior space. In these variants, the washing liquid deflecting surface together with the inner surface of the outer wall portion therefore form a structure in the form of an indentation at which washing liquid entering from below into the side wall at the corresponding point is deflected in very different directions into the rack interior space. A shell-shaped indentation could also be mentioned, with the term shell being understood as meaning that very different shapings or profiles or configurations of the washing liquid deflecting surface and of the inner surface of the outer wall portion are possible.

In general, it can be provided that the washing liquid deflecting surface is inherently curved or inherently angled once or more than once.

At any rate, it is advantageous if a cross-sectional width of the indentation, said cross-sectional width being measured parallel to the standing plane and parallel to the inner surface of the outer wall portion, increases, preferably continuously, in the direction toward the rack interior space.

It is preferably also provided that the washing liquid deflecting surface closes off the indentation at its end opposite the standing plane by an inherently closed deflecting surface region of the washing liquid deflecting surface.

Dish racks according to the invention can be used for washing crockery, glasses and cutlery, but also other objects in correspondingly suitable dishwashers. The dish racks according to the invention can accordingly be used both in the gastronomy sector and in industrial manufacturing.

The rack interior space surrounded by the rack base and the side walls can be open upward, i.e. on the side facing away from the rack base. However, dish racks according to the invention can also be equipped with, optionally grid-like, covers or the like.

The dish racks can basically be manufactured from different materials. Dish racks made of plastic are preferred. The base webs and the side walls, preferably the entire dish rack, can be formed integrally. The dish racks according to the invention can be manufactured, for example, by injection molding.

In case of doubt, the terms above and below relate to an operating position of the dish rack, in which the rack base forms the lower end of the dish rack and, as a rule, stands on a horizontal underlying surface, i.e. the standing plane is a horizontal plane.

The term grid-shaped rack base describes that the rack base has clearances or passage openings between the base webs, through which clearances or passage openings, for example, the washing liquid can enter the rack interior space through the rack base.

As seen in the top view of the dish rack, the dish rack, as known per se, can have a rectangular, in particular square basic shape, but also a basic shape shaped in some other way. The term rectangular or square basic shape also includes configurations in which the corners of said basic shape are rounded.

In addition to the dish rack per se, the invention also relates to an arrangement comprising a dishwasher and comprising a dish rack according to the invention, wherein the dish rack is arranged in the dishwasher and washing liquid nozzles of the dishwasher are arranged underneath the rack base, and a respective washing liquid dispensing direction of the respective washing liquid nozzles is directed toward the side wall. It is preferably provided here that the washing liquid nozzles are arranged in or on a rotatably mounted washing arm of the dishwasher, wherein the washing arm is then likewise located underneath the rack base. In this arrangement, the washing liquid is sprayed by the washing liquid nozzles from below through the rack base and the side wall onto the objects to be washed in the rack interior space. A relatively large amount of the washing liquid dispensed overall by the washing liquid nozzles passes through the clearances or passage openings in the rack base. If the washing liquid strikes in the side wall against the washing liquid deflecting surface(s) according to the invention, it is deflected there, and therefore a multiplicity of different directions are formed in the rack interior space, at which the washing liquid strikes against the objects which are to be washed and are located in the rack interior space. As explained at the beginning, this achieves a particularly good washing result.

In addition, the invention also relates to a method for washing objects in a dishwasher, said objects being arranged in the rack interior space of a dish rack according to the invention, wherein, in order to wash the objects in the dishwasher, the dish rack is arranged above washing liquid nozzles of the dishwasher, and washing liquid is sprayed from the washing liquid nozzles through the side wall or side walls and the rack base into the rack interior space, wherein some of the washing liquid is deflected into the rack interior space by the at least one deflecting surface region which, as seen in the sectional plane parallel to the standing plane, is arranged at the obtuse angle relative to the inner surface of the inner wall portion, said inner surface facing the rack interior space.

The objects which are to be washed and which are arranged in the rack interior space may, as already stated above, be crockery, glasses and cutlery, but also other objects.

BRIEF DESCRIPTION OF THE DRAWINGS

Further features and details of preferred embodiments of the invention will be explained in the following description of the figures, in which.

DETAILED DESCRIPTION

It should first be noted that the dish racks 1 shown here each have a square basic shape with rounded corners. As already explained at the beginning, dish racks 1 according to the invention may however of course also be formed with rectangular basic shapes or other basic shapes, optionally with rounded or else non-rounded corners. Dish racks 1 according to the invention are advantageously manufactured from plastic. It can be provided here that all of the components of the dish rack 1 are connected integrally to one another. However, multi-part variants are also possible. Dish racks 1 according to the invention can be produced, for example, by injection molding.

Figure 1:
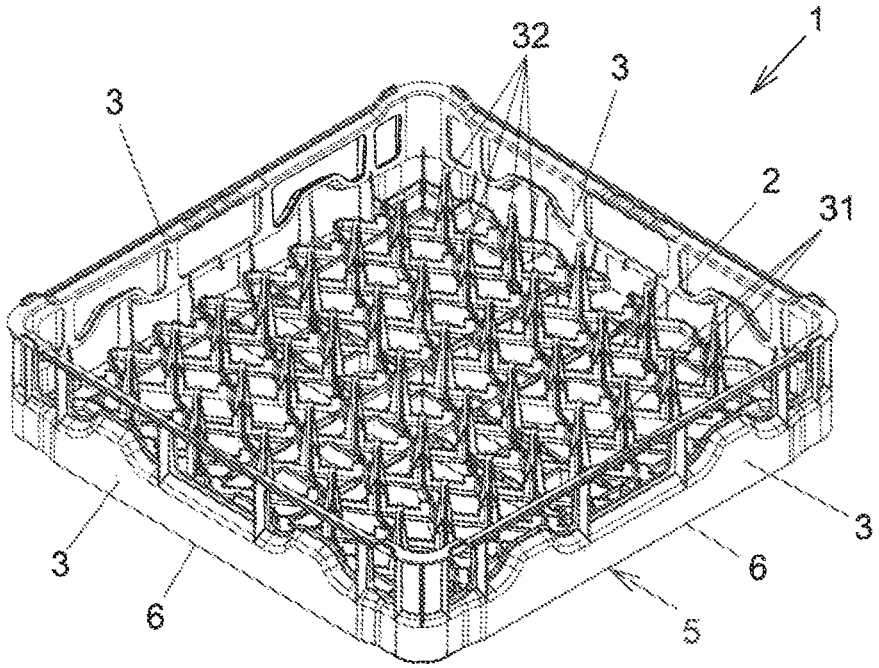
FIGS. 1 to 8 show illustrations for a first exemplary embodiment according to the invention of a dish rack.
Figure 40:
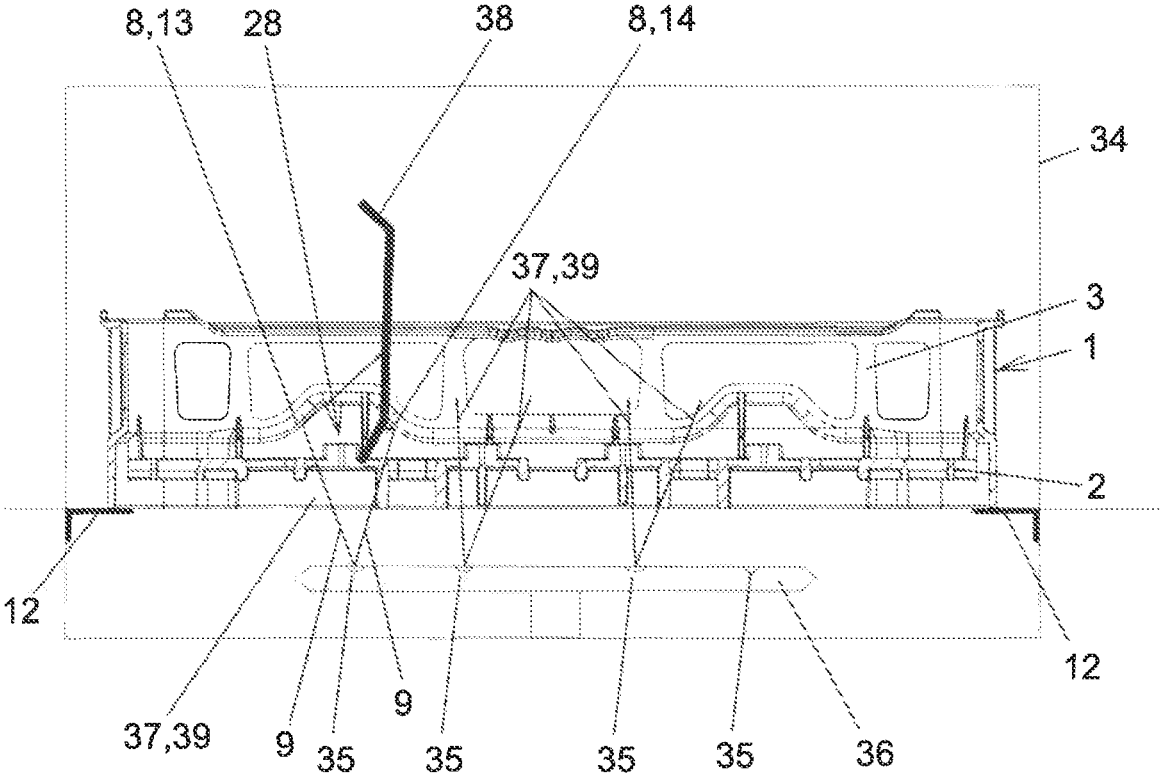
FIG. 40 shows a schematized illustration of an arrangement according to the invention comprising a dishwasher and a dish rack and of a method for washing objects in a dishwasher, said objects being arranged in the rack interior space of a dish rack according to the invention.

FIG. 1, in a perspective view obliquely from above, shows a dish rack 1 which, as known per se, has a grid-shaped rack base 2 which together with the side walls 3 delimit a rack interior space 4. Standing surfaces 6 which end in the standing plane 7 of the dish rack 1 are located on the underside 5 of the dish rack 1 on the base webs 31 of the rack base 2 and/or on the side walls 3. In the normal operating position of the dish rack 1, for example in a dishwasher 34, as is shown in FIG. 40, the standing plane 7 is a horizontal plane. The dish rack is therefore placed with the standing surfaces 6 on a generally horizontal plane. The standing surfaces 6 therefore predetermine the standing plane 7 of the dish rack 1, with which the dish rack 1 can be deposited in the normal position, i.e. with the rack base 2 downward, onto a generally horizontal underlying surface. The standing surfaces 6 can be designed here in the shape of points, in the shape of lines or in some other way. Even when designed in the shape of points, there is ultimately always a certain surface, and therefore the term standing surface 6 is also permissible in this case.

The side walls 3, as also shown in this first exemplary embodiment, can be interrupted in regions with openings. The rack interior space 4 is at any rate open upward in the exemplary embodiments shown.

The dish rack 1 shown here in the first exemplary embodiment is designed primarily for washing plates. In order to support the plates during the washing operation, in said first exemplary embodiment plate supports 32 which are known per se are integrally formed on the rack base 2. Of course, if expedient, other objects 38 may also be washed with a corresponding dish rack 1 according to the first exemplary embodiment. Of course, however, the plate supports 32 may also be omitted.

Figure 2:
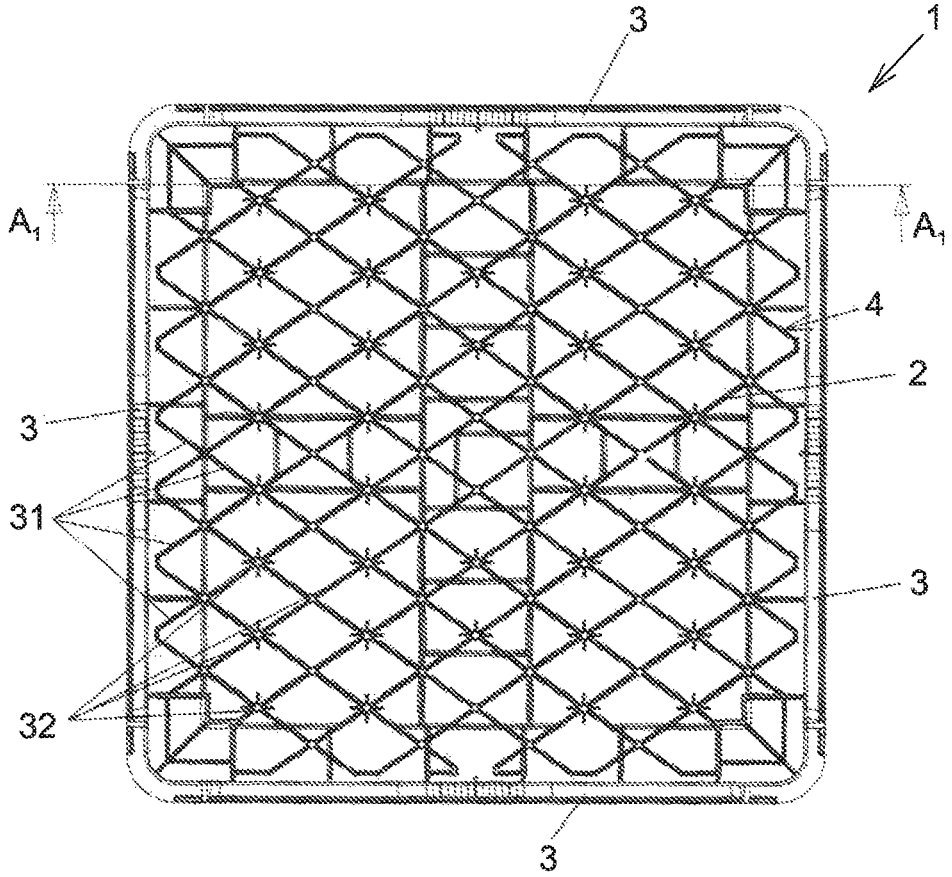

FIG. 2 shows a top view from above of the dish rack 1 according to FIG. 1. It can be seen here that the base webs 31 of the first exemplary embodiment shown here overall form a diamond-shaped structure. The plate supports 32, if present, are advantageously each formed at intersecting points of two base webs 31. Of course, however, all this does not have to be the case and is just one of a multiplicity of possible embodiments for grid-shaped rack bases 2 of a dish rack 1 according to the invention.

Figure 3:
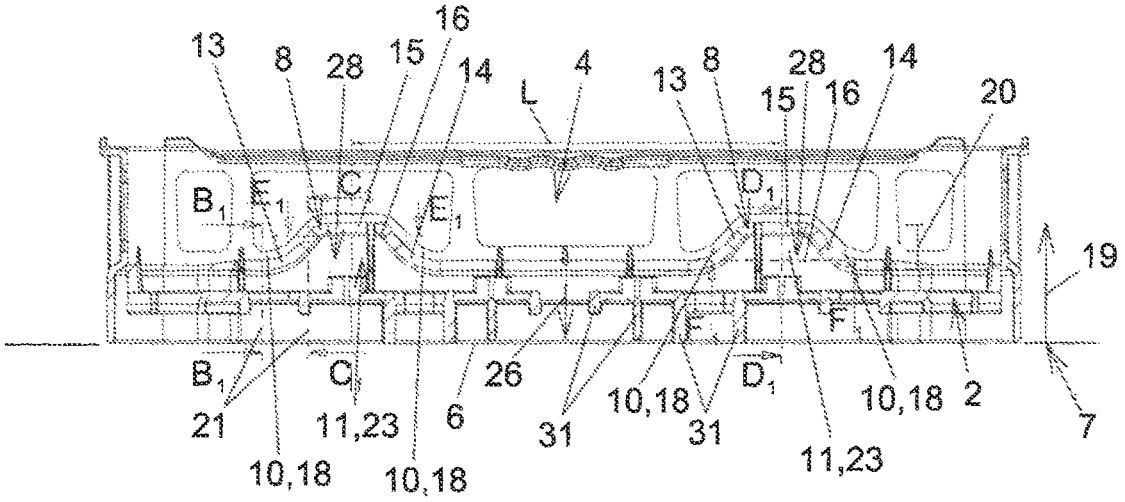

For said first exemplary embodiment according to the invention, FIG. 3 shows a section along the sectional line $A_1$-$A_1$ from FIG. 2 in a sectional plane which is orthogonal to the plane of the sheet of FIG. 2 and is therefore also orthogonal to the standing plane 7 predetermined by the standing surfaces 6. FIG. 3 therefore shows a view from the rack interior space 4 onto the inner side of one of the side walls 3 of the rack base 1. In this illustration, the inherently curved or multiply angled profile of the washing liquid deflecting surface 8 can be seen particularly readily. The washing liquid deflecting surface 8 serves for deflecting the washing liquid jets 9, which penetrate the standing plane 7 from below, into the rack interior space 4. The washing liquid deflecting surface 8 is extended between an inner wall portion 10 of the side wall 3 and an outer wall portion 11 of the side wall 3. The outer wall portion 11 is arranged further on the outside than the inner wall portion 10, as seen from the rack interior space 4. It can readily be seen in FIG. 3 that the washing liquid deflecting surface 8 has differently oriented deflecting surface regions 13, 14 and 15. The latter together with the outer wall portion 11 to which they are directly adjacent form indentations 28 which are open in the direction 27 toward the rack interior space 4 and in the direction 26 toward the standing plane 7, and therefore washing liquid 39 or washing liquid jets 9 penetrate from below through the standing plane 7 into the respective indentation 28 and can then be deflected into the rack interior space 4 in various directions at the various deflecting surface regions 13, 14 and 15 of the washing liquid deflecting surface 8.

For the sake of completeness, it is pointed out that corresponding deflecting surface regions 13, 14 and 15 do not necessarily always have to be connected to one another and also do not together with the outer wall portion 11 have to delimit an indentation 28. In a departure from the exemplary embodiments shown here, deflecting surface regions 13 and 14 arranged according to the invention can also be formed by themselves in the respective side wall 3.

Figure 7:
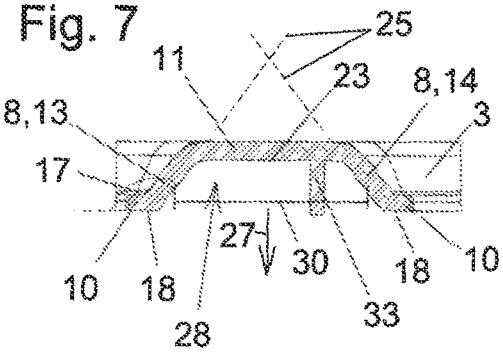
Figure 8:
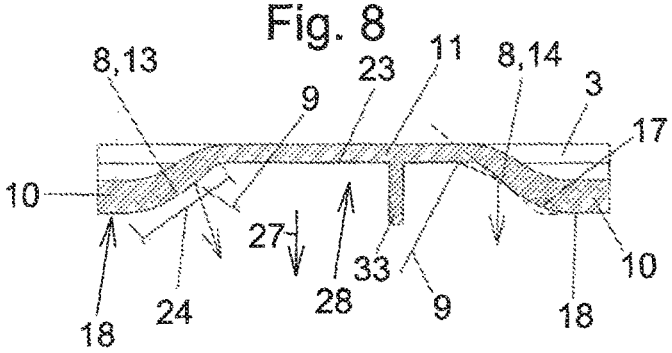
Figure 9:
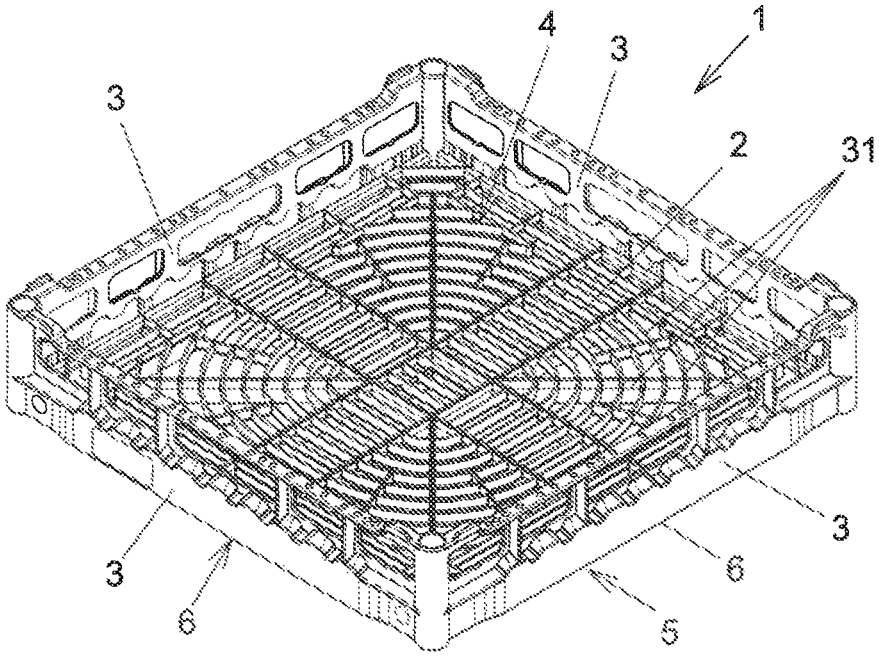
FIGS. 9 to 16 show illustrations for a second exemplary embodiment according to the invention of a dish rack.

In the first exemplary embodiment discussed first of all here, as also in the other exemplary embodiments of the invention, it is provided in each case that the washing liquid deflecting surface 8 has deflecting surface regions 13 and 14 which, as seen in a sectional plane 16 parallel to the standing plane 7, are arranged at an obtuse angle 17 relative to the inner surface 18 of the inner wall portion 10, said inner surface facing the rack interior space 4. FIGS. 7 and 8 show sections in corresponding sectional planes 16 parallel to the standing plane 7. FIG. 7 here is a corresponding section along the sectional line $E_1$-$E_1$ shown in FIG. 3. The sectional plane 16 parallel to the standing plane 7 runs here through the sectional line $E_1$-$E_1$ shown in FIG. 3 and, like the standing plane 7, is orthogonal to the plane of the sheet of FIG. 3. FIG. 8 shows a corresponding section in a sectional plane 16, which is parallel to the standing plane 7, through the sectional line $F_1$-$F_1$ in FIG. 3. FIG. 7 shows the obtuse angle 17 between the inner surface 18 of the inner wall portion 10 and the deflecting surface region 13, which is designed according to the invention, of the washing liquid deflecting surface 8. The obtuse angle 17 is also formed, but not specifically shown, in the opposite deflecting surface region 14, designed according to the invention, of the washing liquid deflecting surface 8.

It can readily be seen in FIGS. 7 and 8 that the deflecting surface regions 13 and 14 together with the outer wall portion 11 or the inner surface 23 thereof in each case delimit an indentation 28 which is open in the direction 27 toward the rack interior space 4. In the first exemplary embodiment shown here, a stiffening web 33 is in each case located in the indentation 28, but said stiffening web may of course also be omitted. FIG. 8 shows that the deflecting surface regions 13 and 14 designed according to the invention do not necessarily have to be formed inherently flat. They may also inherently have a curvature, as can readily be seen in FIG. 8. This does not prevent determining the obtuse angle 17 as is shown by way of example in FIG. 8 at the deflecting surface region 14 and the adjacent inner wall portion 10 or the inner surface 18 thereof, i.e. the surface facing the rack interior space 4.

In order to obtain a correspondingly effective deflecting effect, it is provided that said deflecting surface regions 13 and 14 which, as seen in said parallel sectional plane 16, are arranged at an obtuse angle 17 relative to the inner surface of the inner wall portion 10, have a height extent 20 of at least 5 mm, preferably of at least 10 mm, in the vertical direction 19, shown in FIG. 3, normally to the standing plane 7. This height extent 20 is shown in FIG. 3 for this exemplary embodiment.

In preferred embodiments, the extent 24 which is shown in FIG. 8 and is measured along said deflecting surface region 13 is intended to be at least 5 mm, preferably at least 10 mm, in order to achieve a corresponding effectiveness during the deflection of the washing liquid jets 9. The extent is measured here directly along the deflecting surface region 13 or 14 in the sectional plane 16, which is parallel to the standing plane 7, between the inner surface 18 of the inner wall portion 10 and the inner surface 23 of the outer wall portion 11. If the deflecting surface region 13 or 14 is curved in said sectional plane 16, the measurement thus takes place along said curvature.

The obtuse angles 17 shown in FIGS. 7 and 8 are advantageously within a range of 91° to 160°, preferably of 95° to 140°.

It can also be readily seen in FIGS. 7 and 8 that, in preferred embodiments like the embodiment shown here, as seen in the parallel sectional plane 16 mentioned, two of the deflecting surface regions 13 and 14 of the washing liquid deflecting surface 8, which deflecting surface regions are arranged at the obtuse angle 17, jointly and directly adjoin the outer wall portion 11 lying in each case therebetween on mutually opposite sides. It is advantageously provided here that the extensions 25 of the two deflecting surface regions 13 and 14 that are shown in FIG. 7 intersect outside the dish rack 1, as seen in the sectional plane 16 parallel to the standing plane 7. It is also preferred that the cross-sectional width 30 of the indentation 28 that is measured parallel to the standing plane 7 and parallel to the inner surface 18 of the outer wall portion 11 increases, preferably continuously, in the direction 27 toward the rack interior space 4. This cross-sectional width 30 is shown by way of example in FIG. 7.

Figure 4:
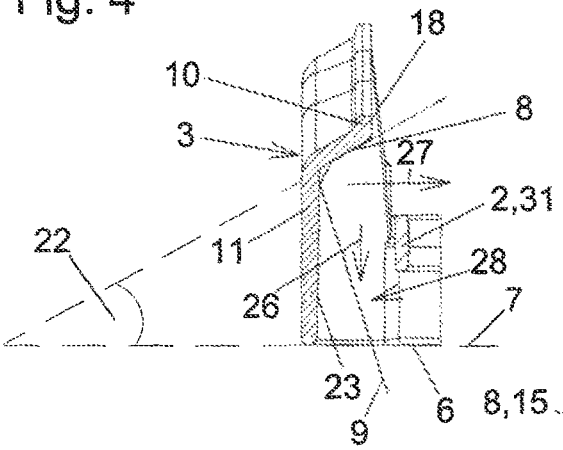
Figure 5:
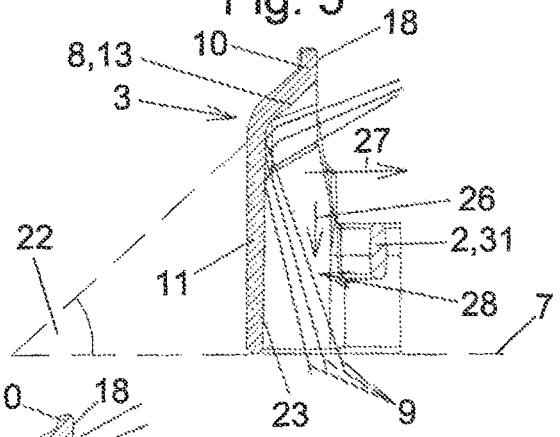
Figure 6:
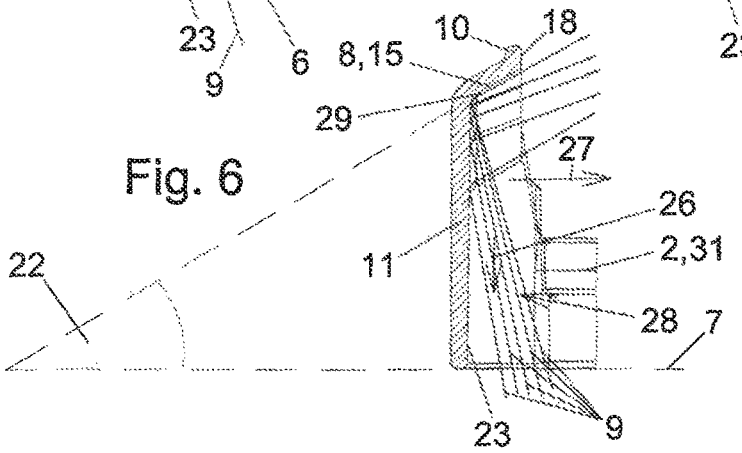

FIGS. 4, 5 and 6 each show sectional planes 21 which are orthogonal to the standing plane 7. FIG. 4 shows the section along the sectional line $B_1$-$B_1$ that is shown in FIG. 3, wherein the orthogonal sectional plane 21 here is orthogonal to the standing plane 7 and also orthogonal to the plane of the sheet of FIG. 3. FIG. 5 shows the corresponding section along the sectional line $C_1$-$C_1$ and FIG. 6 along the sectional line $D_1$-$D_1$ from FIG. 3, wherein the respective orthogonal sectional planes 21 of FIGS. 5 and 6 are likewise orthogonal to the standing plane 7 and also to the plane of the sheet of FIG. 3.

It can readily be seen in FIGS. 4, 5 and 6 that the washing liquid deflecting surface 8 in each case encloses an acute angle 22 with the standing plane 7 in its various deflecting surface regions, as seen in the respective orthogonal sectional planes 21. This also applies in this exemplary embodiment, as can readily be seen in FIG. 5 or section $C_1$-$C_1$, to the deflecting surface regions 13 and 14 which, as seen in the sectional plane 16 parallel to the standing plane 7, are arranged at the obtuse angle 17 relative to the inner surface 18 of the inner wall portion 10, said inner surface facing the rack interior space 4.

The sectional illustrations according to FIGS. 4 to 6 and 8 illustrate by way of example individual washing liquid jets 9 which are intended to symbolize how the washing liquid 39 or the washing liquid jets 9 are deflected into the rack interior space 4 in various directions at the various deflecting surface regions 13, 14 and 15 of the washing liquid deflecting surface 8 in order thus to strike from very varied directions against the objects 38 located in the rack interior space 4 during a washing operation and to optimize the washing result.

The deflecting surface region 15 of the washing liquid deflecting surface 8 that is illustrated in FIGS. 3 and 6 forms the upper end 29 of the indentation 28. This deflecting surface region is indeed arranged in the orthogonal sectional plane 21 at an acute angle 22 relative to the standing plane 7 in this exemplary embodiment. However, the deflecting surface region 15 is not designed according to the invention since, in a sectional plane 16 which is not illustrated separately here and is parallel to the standing plane 7, it does not enclose an obtuse angle 17 with the inner surface 18 of the adjacently arranged inner wall portion 10. This first exemplary embodiment therefore shows that the washing liquid deflecting surface 8 of dish racks 1 according to the invention can have deflecting surface regions 13 and 14 designed according to the invention and also deflecting surface regions 15 not designed according to the invention or according to the prior art.

In general terms, it should be pointed out here that the deflecting surface regions 13 and 14 according to the invention of the respective washing liquid deflecting surface 8, which deflecting surface regions are formed in a side wall 3, can be present in very different numbers and at very different distances from one another. The shaping may also be very different. The deflecting surface regions 13, 14 and 15 may be joined to one another, but may also be formed separately from one another. The distance L between the two adjacent indentations 28 formed in a side wall 3 can be designed in accordance with the size of the dish rack 1 and the number of indentations 28 or deflecting surface regions 13, 14 and may assume very different orders of magnitude.

Further exemplary embodiments according to the invention of dish racks 1 will be explained below with reference to FIGS. 9 to 39. In order to avoid repetitions, only the differences over the first exemplary embodiment already described will, however, be discussed. Otherwise, reference is made to the above descriptions for the first exemplary embodiment. These also apply, to the extent usable, to the exemplary embodiments described below.

Figure 10:
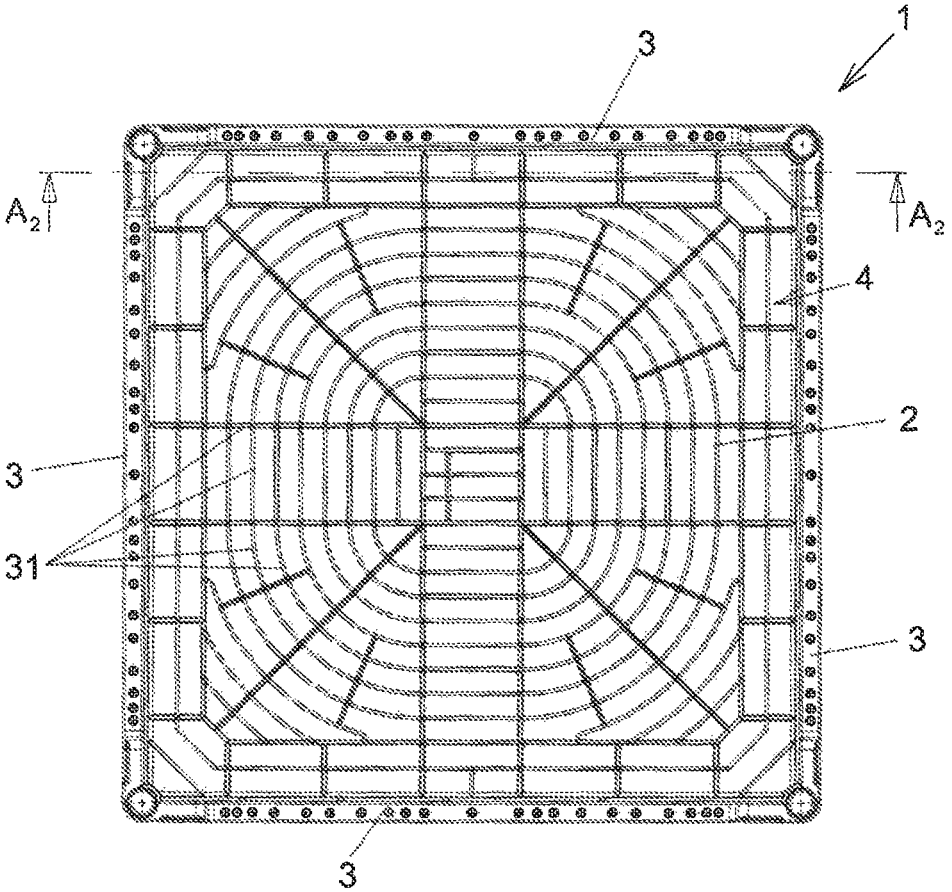
Figure 11:
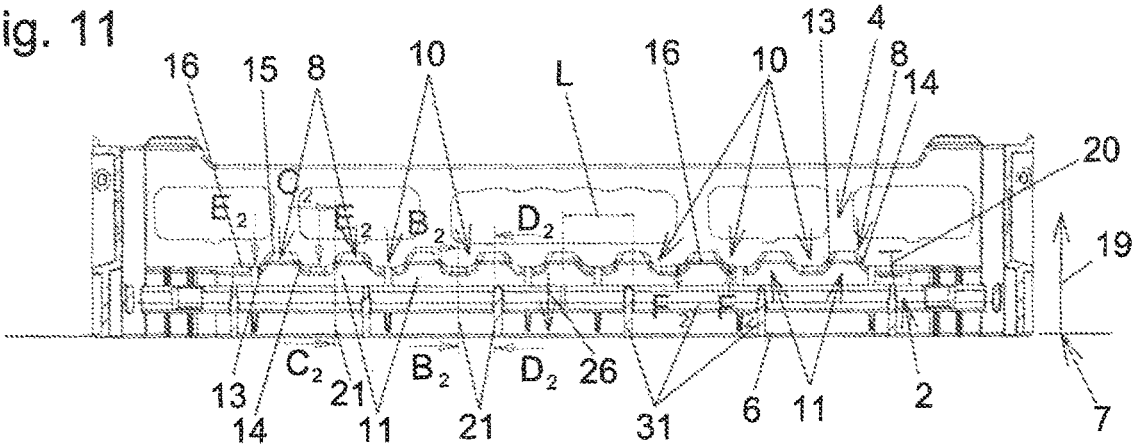
Figure 15:
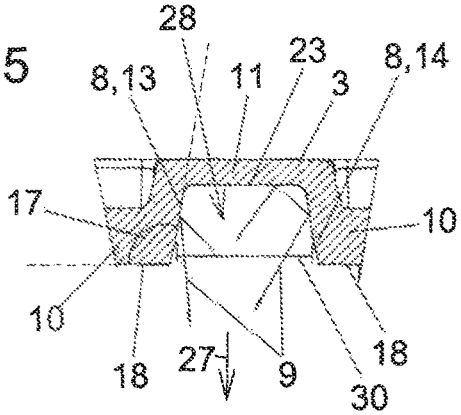
Figure 16:
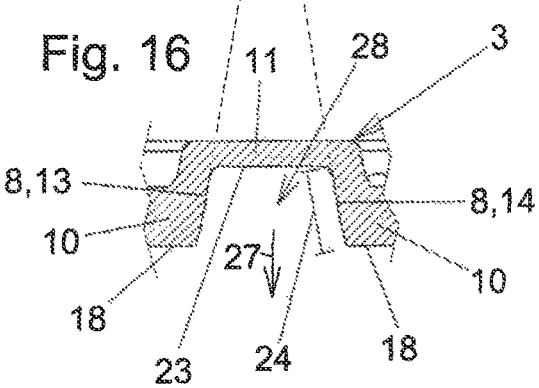

A second exemplary embodiment of a dish rack 1 according to the invention is shown in FIGS. 9 to 16. In the perspective view from above according to FIG. 9, it can readily be seen that there are no plate supports 32 here in the dish rack 1. Therefore, a very wide variety of types of objects 38 to be washed, for example glasses, dishes, pans and the like, can be arranged in the rack interior space 4 in order thereby to be washed in a dishwasher 34. However, said dish rack 1 can also be used, for example, in industrial manufacturing for washing corresponding objects 38. FIG. 10 shows a top view of said dish rack 1 of the second exemplary embodiment. FIG. 11 shows a section along the sectional line $A_2$-$A_2$ in a sectional plane orthogonal to the plane of the sheet of FIG. 10. It can readily be seen there that, in the case of this dish rack 1, as compared to the first exemplary embodiment, the washing liquid deflecting surface 8 is of overall smaller scale. In the second exemplary embodiment, there is a greater number of deflecting surface regions 13 and 14 designed according to the invention per side wall 3, the distance L of which from one another and also the height extent 20 of which are smaller than in the first exemplary embodiment. Between in each case two deflecting surface regions 13 and 14 according to the invention, there is in turn in each case a deflecting surface region 15 which, as seen in the orthogonal sectional plane 21, encloses an acute angle 22 with the standing plane 7 but, as seen in a sectional plane 16 parallel to the standing plane 7, does not enclose an obtuse angle 17 with the inner surface 18 of the inner wall portion 10. The deflecting surface regions 13 and 14, by contrast, have this feature according to the invention. This can readily be seen in FIGS. 15 and 16, wherein FIG. 15 shows the section in the sectional plane 16, which is parallel to the standing plane 7, along the sectional line $E_2$-$E_2$ and FIG. 16 shows the section in the sectional plane 16, which is parallel to the standing plane 7, along the sectional line $F_2$-$F_2$ from FIG. 11.

Figure 12:
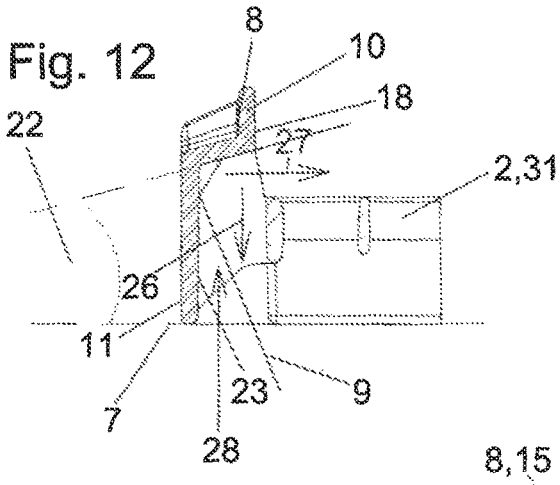
Figure 13:
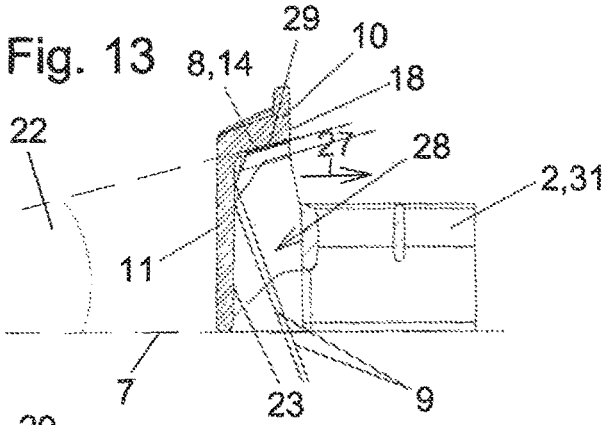
Figure 14:
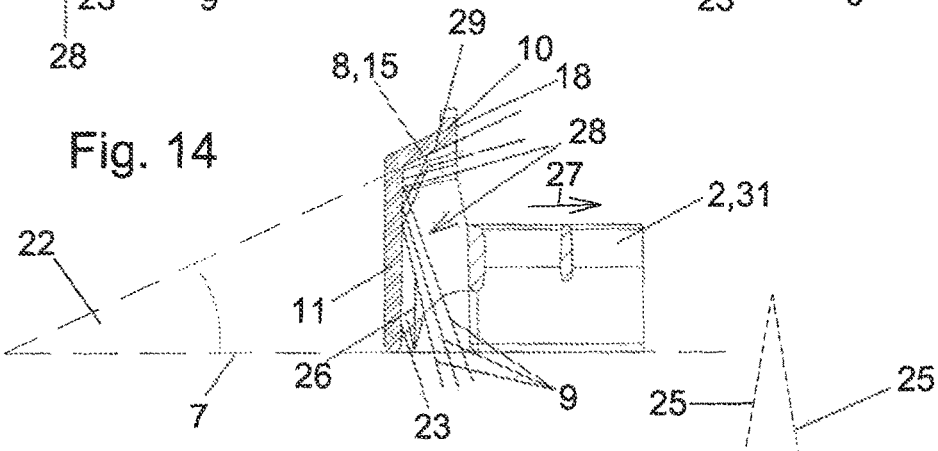

FIG. 12 shows a section in the sectional plane 21, which is orthogonal to the standing plane 7, along the sectional line $B_2$-$B_2$ from FIG. 11. FIG. 13 shows a corresponding section along the sectional line $C_2$-$C_2$ and FIG. 14 along the sectional line $D_2$-$D_2$ from FIG. 11. It can in turn readily be seen in FIGS. 12, 13 and 14 that, as viewed in said orthogonal sectional planes 21, the washing liquid deflecting surface 8 in each case encloses an acute angle 22 with the standing plane 7. This therefore also applies to the deflecting surface regions 13 and 14 which are designed according to the invention, as can be seen by way of example with reference to the deflecting surface region 14 in FIG. 13.

Figure 17:
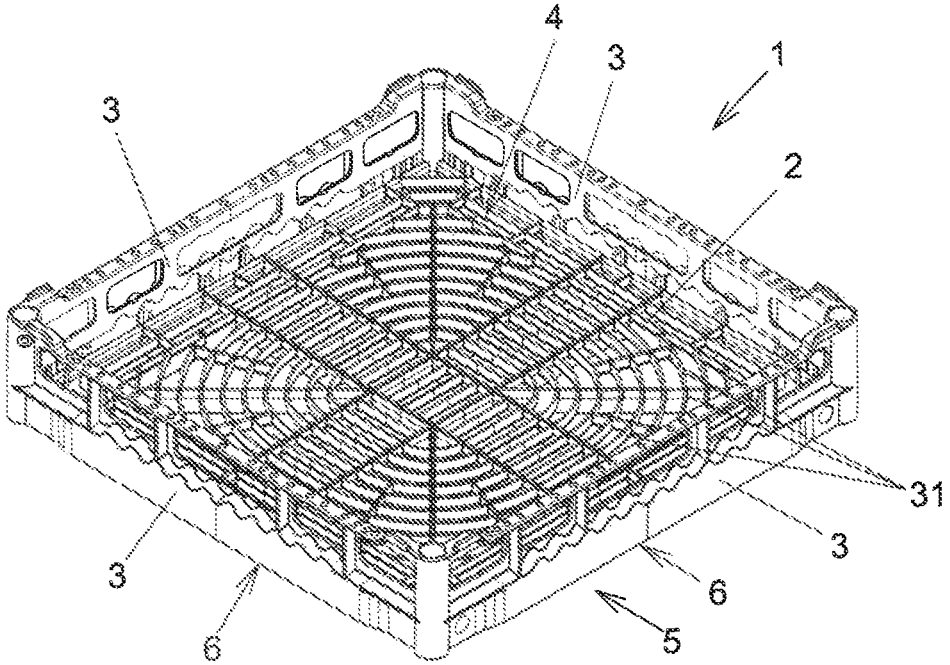
FIGS. 17 to 24 show illustrations for a third exemplary embodiment according to the invention of a dish rack.
Figure 18:
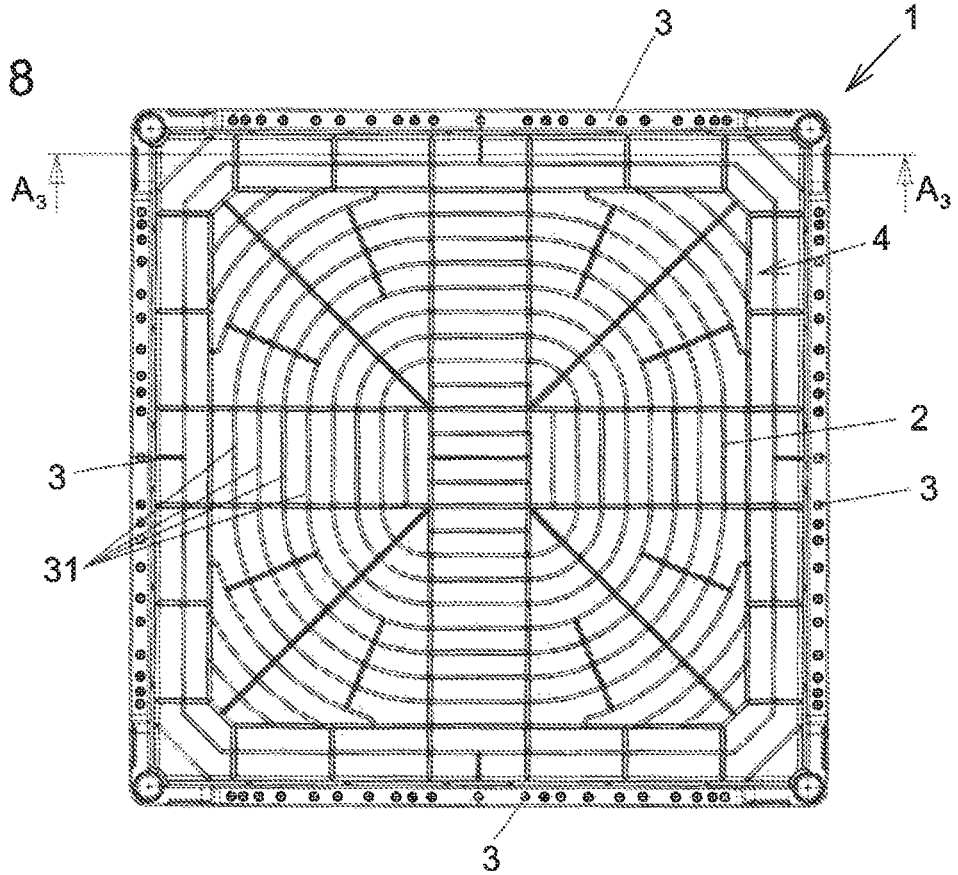
Figure 19:
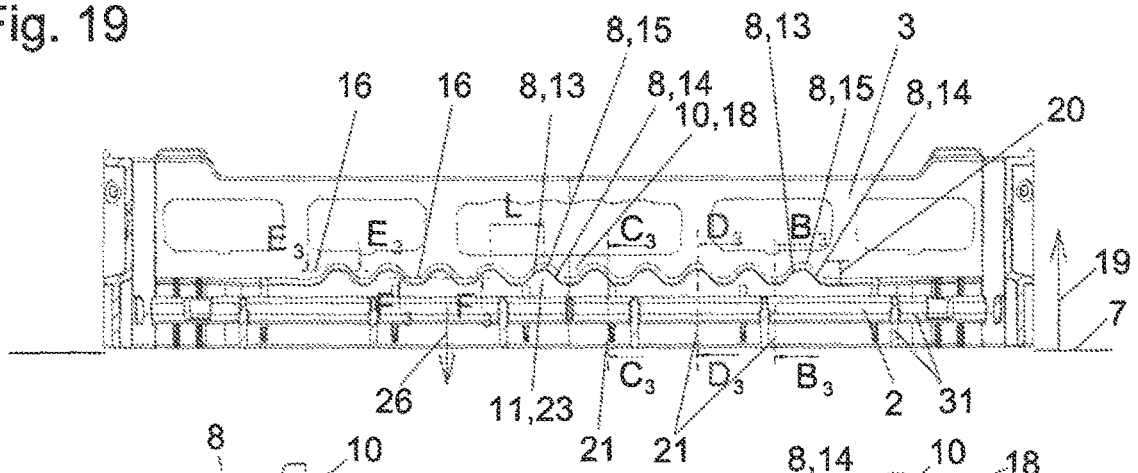
Figure 20:
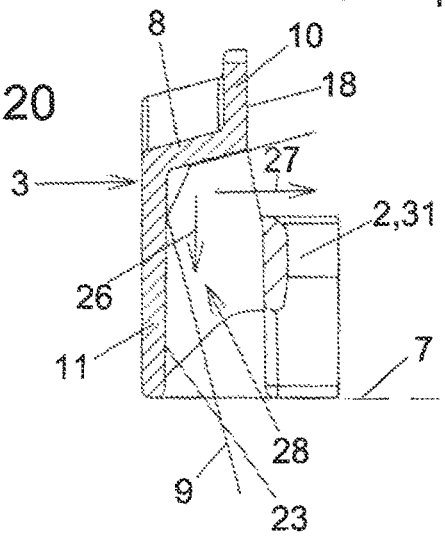
Figure 21:
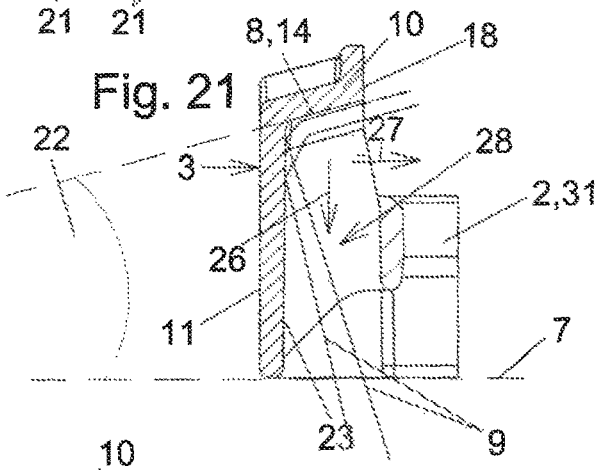
Figure 22:
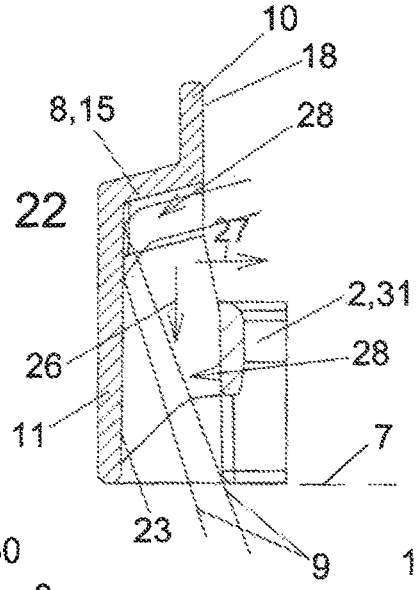
Figure 23:
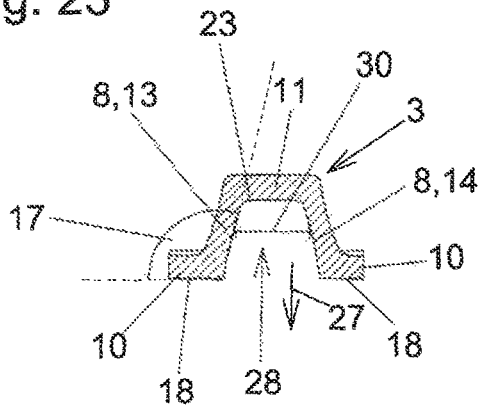
Figure 24:
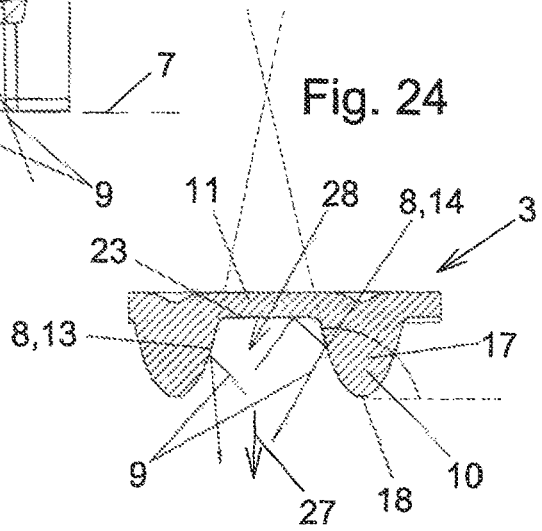

The third exemplary embodiment according to the invention of a dish rack 1 is shown in FIGS. 17 to 24. FIG. 17 in turn shows a perspective view obliquely from above of the dish rack 1, FIG. 18 shows a top view. The section along the sectional line $A_3$-$A_3$ is shown in FIG. 19. FIG. 20 shows the sectional plane 21, which is orthogonal to the standing plane 7, along the sectional line $B_3$-$B_3$ from FIG. 19, FIG. 21 the corresponding orthogonal sectional plane 21 along the sectional line $C_3$-$C_3$ from FIG. 19 and FIG. 22 the section in the orthogonal sectional plane 21 along the sectional line $D_3$-$D_3$. The configuration according to the invention of the deflecting surface regions 13 and 14 is shown in the sections along the sectional plane 16, which is parallel to the standing plane 7, in FIGS. 23 and 24, wherein FIG. 23 shows the section along the sectional line $E_3$-$E_3$ and FIG. 24 the section along the sectional line $F_3$-$F_3$ in FIG. 19. The sole difference over the previously mentioned exemplary embodiments according to the invention is that here the washing liquid deflecting surface 8, in the view according to FIG. 19, forms a wavy structure. This does not make any change to the deflecting surface regions 13 and 14 being designed according to the invention, see FIGS. 23 and 24.

Figure 25:
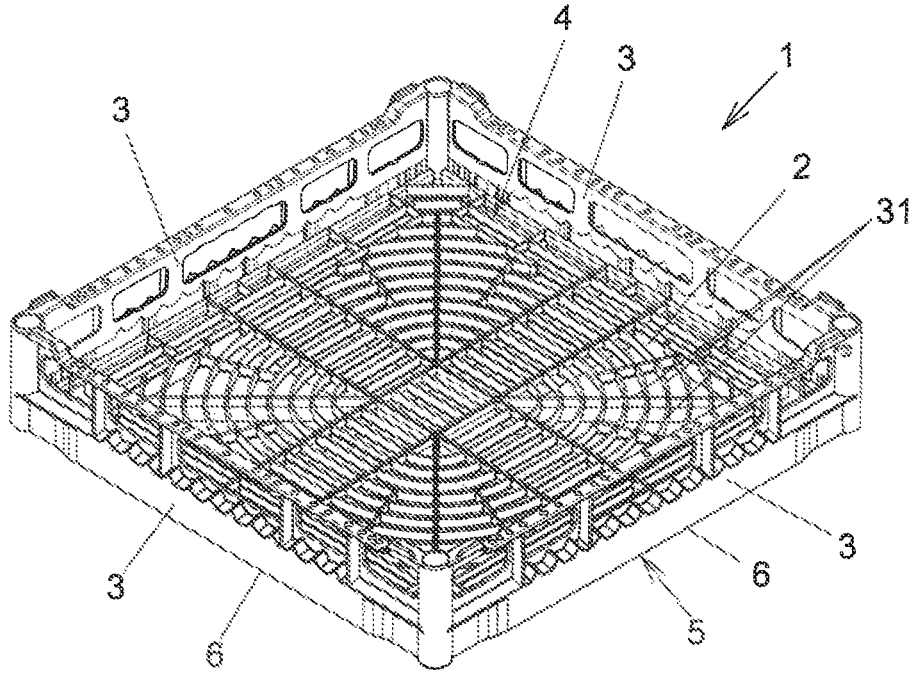
FIGS. 25 to 31 show illustrations for a fourth exemplary embodiment according to the invention of a dish rack.
Figure 26:
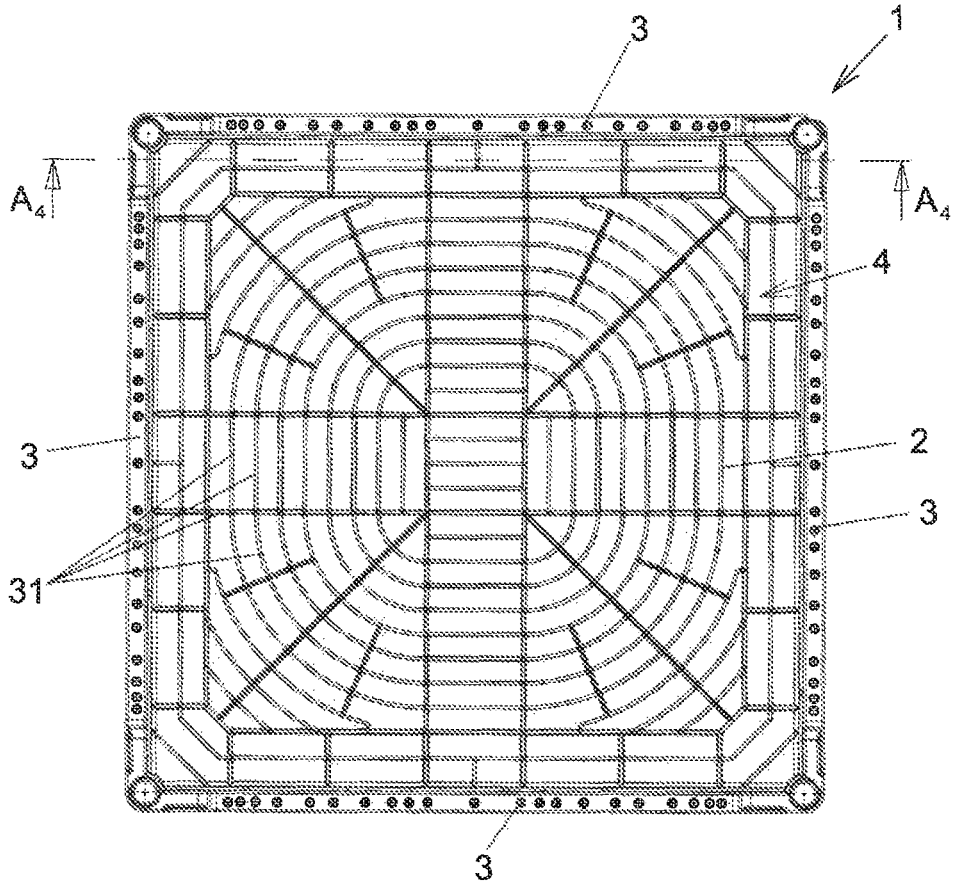
Figure 27:
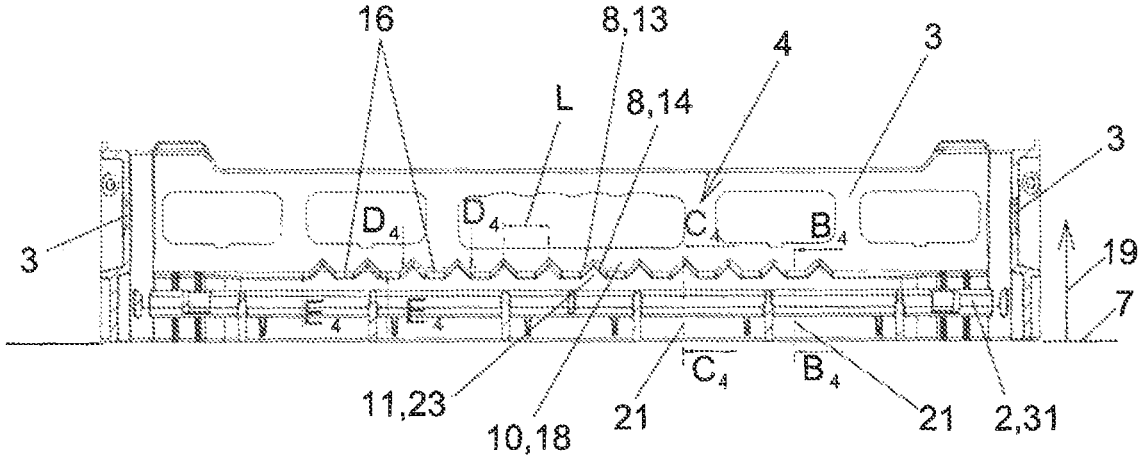
Figure 28:
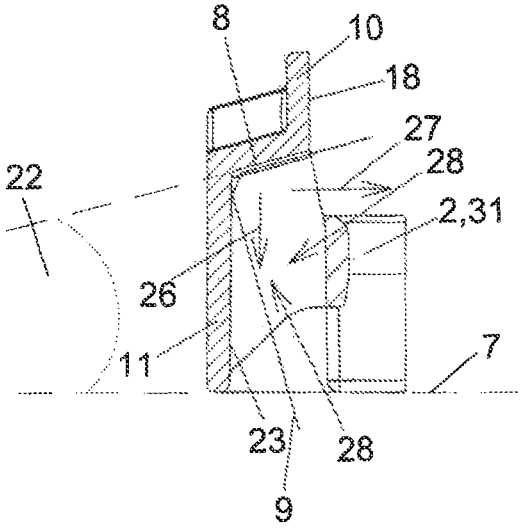
Figure 29:
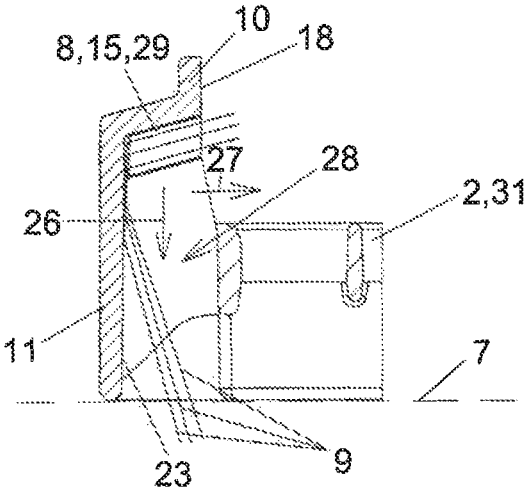
Figure 30:
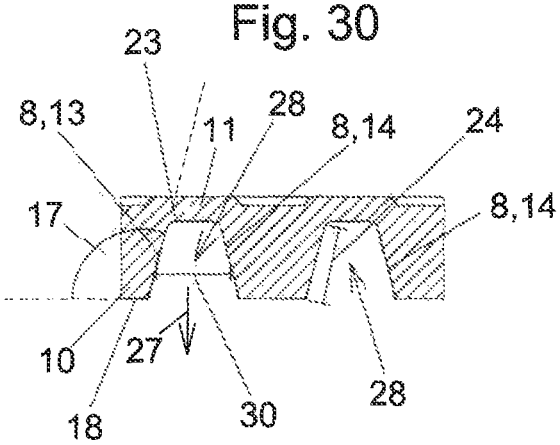
Figure 31:
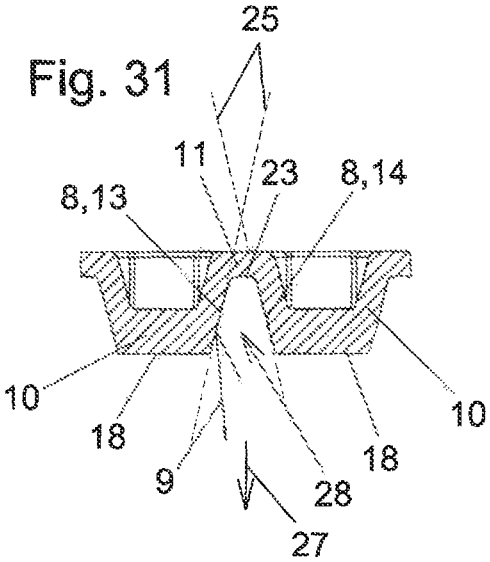
Figure 32:
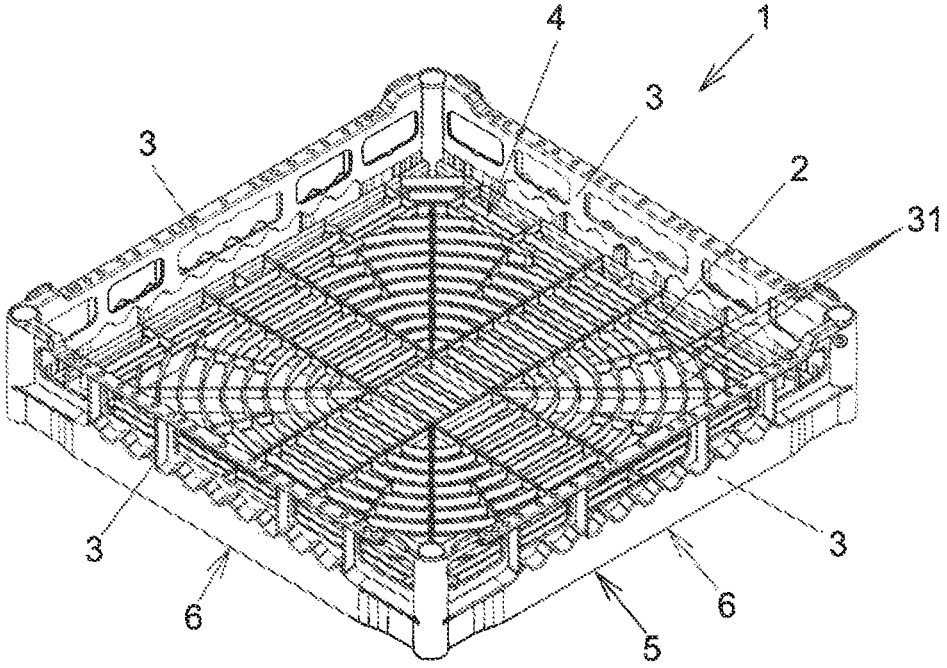
FIGS. 32 to 39 show illustrations for a fifth exemplary embodiment according to the invention of a dish rack.

In the fourth exemplary embodiment according to the invention of a dish rack, FIG. 25 in turn shows a view obliquely from above and FIG. 26 shows a top view of the dish rack 1. The section which is orthogonal to the standing plane 7 along the sectional line $A_4$-$A_4$ from FIG. 26 is shown in FIG. 27. FIG. 28 shows the section in the sectional plane 21, which is orthogonal to the standing plane 7, along the sectional line $B_4$-$B_4$ and FIG. 29 shows the section in the sectional plane 21, which is orthogonal to the standing plane 7, along the sectional line $C_4$-$C_4$ from FIG. 27. The configuration according to the invention of the deflecting surface regions 13 and 14 can in turn be readily seen in FIGS. 30 and 31, wherein FIG. 30 shows the section in the sectional plane 16, which is parallel to the standing plane 7, along the sectional line $D_4$-$D_4$ and FIG. 31 shows the section in the parallel sectional plane 16 along the sectional line $E_4$-$E_4$ from FIG. 27. In this exemplary embodiment, the deflecting surface regions 13 and 14 designed according to the invention form a type of roof or triangular structure in the view according to FIG. 27. They are in contact directly at the upper end 29 of the respective indentation 28 without a deflecting surface region 15 being arranged in between in this exemplary embodiment. Otherwise, the statements above regarding the other exemplary embodiments according to the invention again apply.

Figure 33:
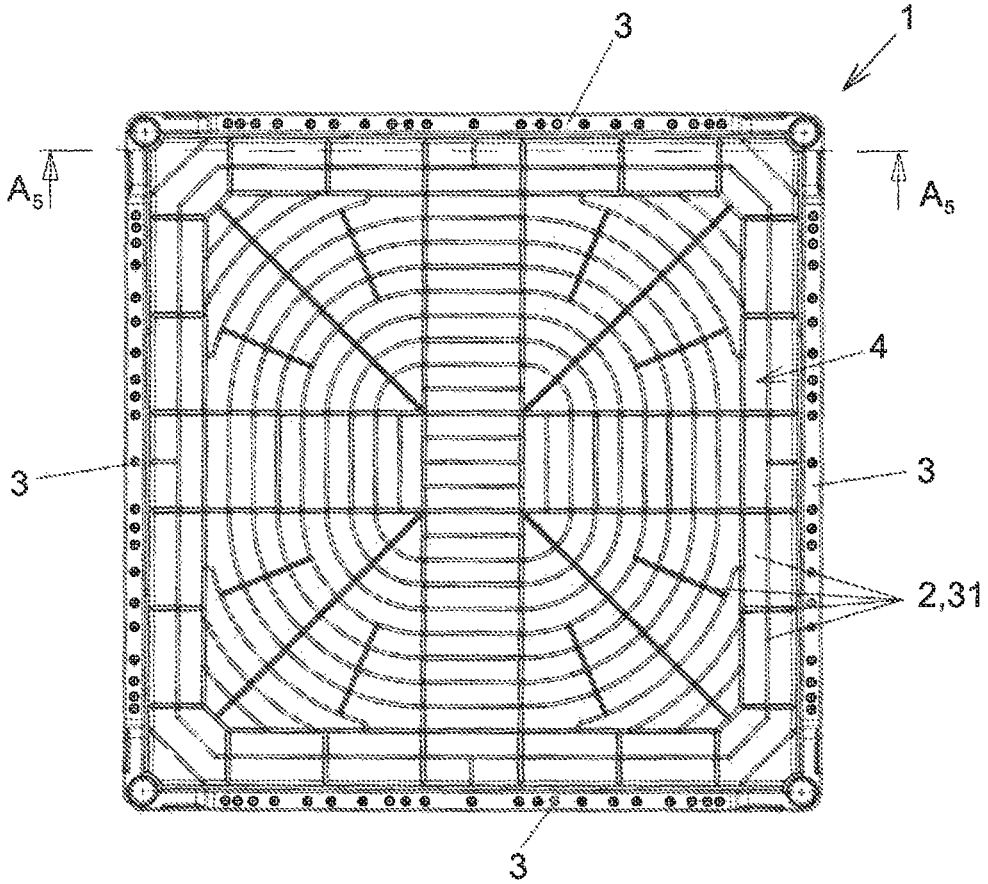
Figure 34:
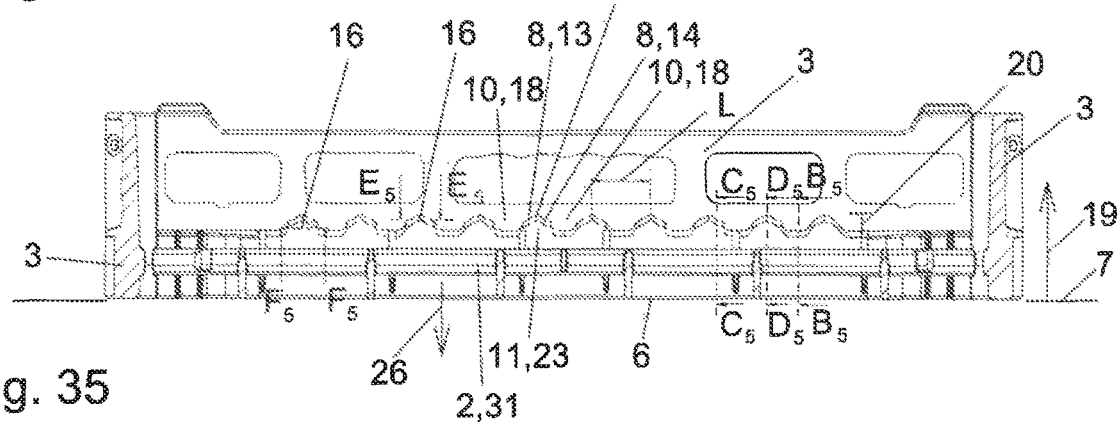
Figure 35:
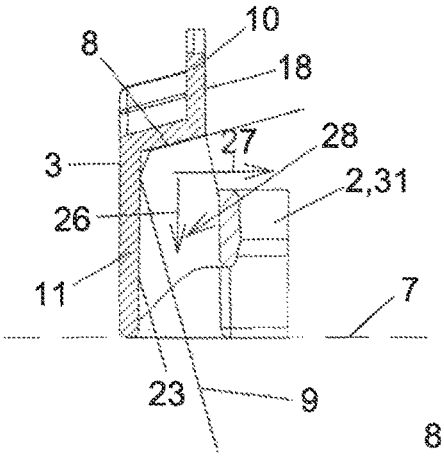
Figure 36:
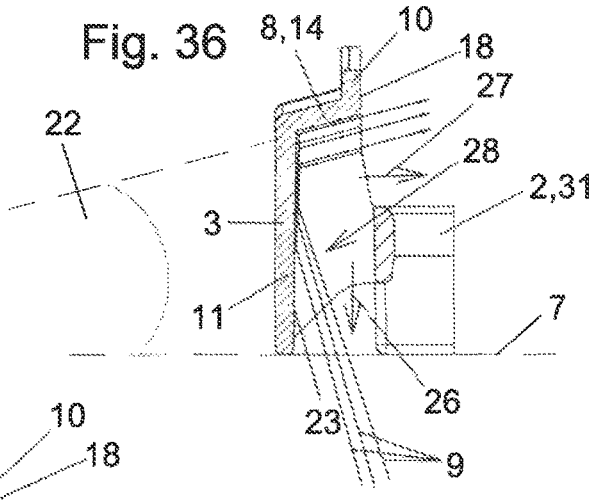
Figure 37:
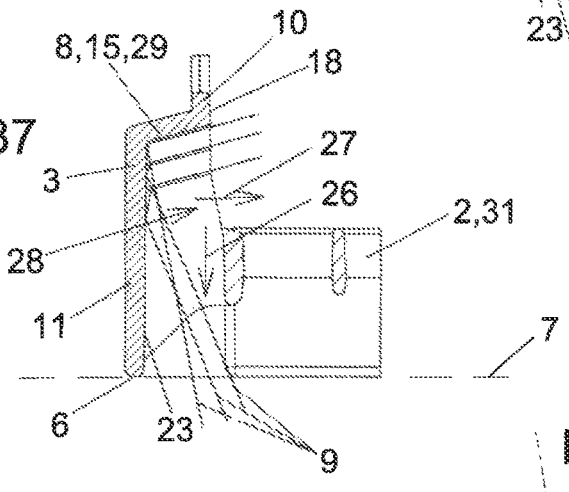
Figure 38:
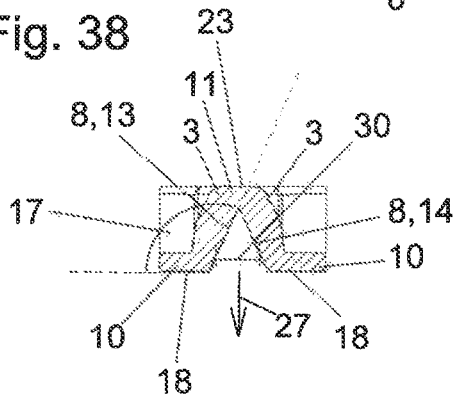
Figure 39:
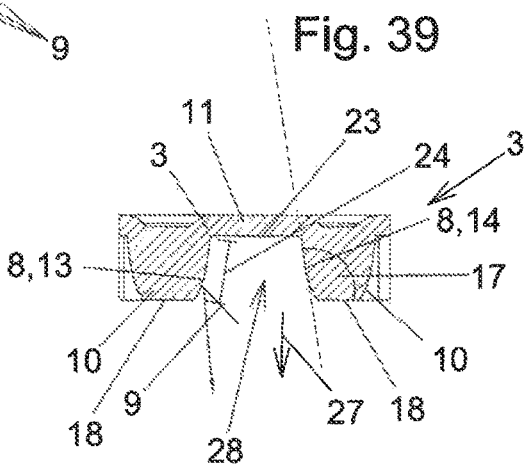

FIGS. 32 to 39 show a fifth exemplary embodiment according to the invention of a dish rack 1, wherein FIG. 32 again shows a perspective view obliquely from above and FIG. 33 shows a top view. The section in an orthogonal sectional plane along the sectional line $A_5$-$A_5$ from FIG. 33 is shown in FIG. 34. FIG. 35 shows the section in a sectional plane 21, which is orthogonal to the standing plane 7, along the sectional line $B_5$-$B_5$, FIG. 36 shows the corresponding section along the sectional line $C_5$-$C_5$ and FIG. 37 along the sectional line $D_5$-$D_5$. The configuration according to the invention of the deflecting surface regions 13 and 14 is again illustrated in FIGS. 38 and 39. FIG. 38 shows the section in a sectional plane 16, which is parallel to the standing plane 7, along the sectional line $E_5$-$E_5$ and FIG. 39 shows the corresponding section along the sectional line $F_5$-$F_5$ from FIG. 34. In this fifth exemplary embodiment, the deflecting surface regions 13 and 14 likewise form a roof-shaped structure, as can readily be seen in FIG. 34. FIG. 38 shows that the two deflecting surface regions 13 and 14, as seen in the sectional plane parallel to the standing plane 7, can also intersect in the outer wall portion 11 of the dish rack 1.

FIG. 40 shows by way of example an arrangement comprising a dishwasher 34 and a dish rack 1 according to the invention arranged therein, wherein the dishwasher 34 is illustrated only in highly simplified form. The dishwasher 34 can be designed as known per se in the prior art. A dish rack 1 according to the first exemplary embodiment is located in the dishwasher 34 in FIG. 40. FIG. 40 shows a vertical section in which the sectional plane is orthogonal to the standing plane 7. In principle, this is a section along the sectional plane $A_1$-$A_1$ from FIG. 2, wherein here too the dishwasher 34 is correspondingly sectioned. For the sake of completeness, it should be pointed out that, of course, any other dish rack 1 according to the invention and in particular the dish racks 1 according to the exemplary embodiments 2, 3, 4 and 5 shown here can be arranged in a corresponding manner in the dishwasher 34.

The disk rack 1 is mounted on corresponding rails 12 of the dishwasher 34 at any rate in the operating position shown in FIG. 40. FIG. 40 therefore shows the operating position of the dish rack 1, in which the washing operation is carried out in the dishwasher 34. In said operating position or normal position, the dish rack 1 is mounted horizontally in the dishwasher 34, and the standing plane 7 of the dish rack 1 is therefore a horizontal plane.

A plate, illustrated in section, as an object 38 to be washed is depicted in schematized form in the rack interior space 4 in FIG. 40. The washing liquid nozzles 35 which, in the exemplary embodiment shown here, are formed in a rotatably mounted washing arm 36 of the dishwasher 34 are located underneath the rack base 2. The washing arm 36 is only illustrated in shortened form in FIG. 40 since, in this operating position, in which its outer washing liquid nozzles 35 spray washing liquid 39 from below into the side walls 3 of the dish rack 1, it would protrude out of the plane of the drawing of FIG. 40, as seen three-dimensionally.

The washing liquid dispensing directions 37 of the respective washing liquid nozzles 35 are at any rate directed toward the rack base 2 and also toward the side walls 3, and therefore some of the washing liquid 39 in the form of washing liquid jets 9 passes during the washing operation from below through the grid-shaped rack base 2 directly into the rack interior space 4. Another portion of the washing liquid 39 or washing liquid jets 9 is sprayed or injected from below into the indentations 28 in the side walls 3 and then deflected by the washing liquid deflecting surface 8 and in particular by deflecting surface regions 13 and 14 designed according to the invention and sprayed or injected into the rack interior space 4. By this means, the objects 38 which are to be washed and which are arranged in the rack interior space 4 are acted upon and washed with washing liquid 39 from very different directions, which leads overall to a very good washing result. FIG. 40 shows, with reference to two washing liquid jets 9 selected by way of example, how the deflecting surface regions 13 and 14 deflect the washing liquid 39 or the washing liquid jets 9 in the direction toward the object 38 to be washed.

FIG. 40 therefore also shows by way of example a method according to the invention for washing objects 38 in a dishwasher 34, said objects being arranged in the rack interior space 4 of a dish rack 1 according to the invention, wherein, in order to wash the objects 38 in the dishwasher 34, the dish rack 1 is arranged above washing liquid nozzles 35 of the dishwasher 34. In the exemplary embodiment shown, the washing liquid nozzles 35 are located in a rotatably mounted washing arm 36 of the dishwasher 34, but this does not necessarily have to be the case. The washing liquid 39 is at any rate sprayed from the washing liquid nozzles 35 through the side walls 3 and the rack base 2 into the rack interior space 4, wherein parts of the washing liquid 39 of the deflecting surface regions 13 and 14 designed according to the invention are deflected into the rack interior space 4. The overall effect which is thereby achieved is that the objects 38 which are to be washed and which are arranged in the rack interior space 4 are struck by washing liquid 39 from very different directions, which leads overall to a very good washing result.

Key to the Reference Numbers:

| | |
|---|---|
| 1 | Dish rack |
| 2 | Rack base |
| 3 | Side wall |
| 4 | Rack interior space |
| 5 | Underside |
| 6 | Standing surface |
| 7 | Standing plane |
| 8 | Washing liquid deflecting surface |
| 9 | Washing liquid jet |
| 10 | Inner wall portion |
| 11 | Outer wall portion |
| 12 | Rail |
| 13 | Deflecting surface region |
| 14 | Deflecting surface region |
| 15 | Deflecting surface region |
| 16 | Parallel sectional plane |
| 17 | Obtuse angle |
| 18 | Inner surface |
| 19 | Vertical direction |
| 20 | Height extent |
| 21 | Orthogonal sectional plane |
| 22 | Acute angle |
| 23 | Inner surface |
| 24 | Extent |
| 25 | Imaginary extension |
| 26 | Direction |
| 27 | Direction |
| 28 | Indentation |
| 29 | End |
| 30 | Cross-sectional width |
| 31 | Base web |
| 32 | Plate support |
| 33 | Stiffening web |
| 34 | Dishwasher |
| 35 | Washing liquid nozzles |
| 36 | Washing arm |
| 37 | Washing liquid dispensing direction |

-continued

| | |
|---|---|
| 38 | Object |
| 39 | Washing liquid |

The invention claimed is:

1. A dish rack for dishwashers, the dish rack comprising:

a grid-shaped rack base;

side walls connected to the grid-shaped rack base, the side walls together with the grid-shaped rack base surrounding a rack interior space of the dish rack;

at least one of the rack base or the side walls having standing surfaces on an underside of the dish rack, said standing surfaces ending in a standing plane of the dish rack;

at least one of the side walls including at least one washing liquid deflecting surface configured to deflect a washing liquid jet, which penetrates the standing plane, into the rack interior space, the washing liquid deflecting surface extending between an inner wall portion of the side wall and an outer wall portion of the side wall, the outer wall portion being arranged further outside, as seen from the rack interior space, than the inner wall portion; and the washing liquid deflecting surface has at least one deflecting surface region which, as seen in a sectional plane parallel to the standing plane, is arranged at an obtuse angle relative to an inner surface of the inner wall portion, said inner surface facing the rack interior space, wherein the deflecting surface region has a height extent of at least 5 mm in a vertical direction normal to the standing plane.

2. The dish rack as claimed in claim 1, wherein the height extent is at least 10 mm.

3. The dish rack as claimed in claim 1, wherein the obtuse angle lies within a range of 91° to 160°.

4. The dish rack as claimed in claim 1, wherein the obtuse angle lies within a range of 95° to 140°.

5. The dish rack as claimed in claim 1, wherein the deflecting surface region which, as seen in the sectional plane parallel to the standing plane, is arranged at the obtuse angle relative to the inner surface of the inner wall portion, said inner surface facing the rack interior space, and further, as seen in a sectional plane orthogonal to the standing plane, encloses an acute angle with the standing plane.

6. The dish rack as claimed in claim 1, wherein the deflecting surface region, as seen in the sectional plane parallel to the standing plane, between the inner surface of the inner wall portion and an inner surface of the outer wall portion, said inner surface facing the rack interior space, has an extent of at least 5 mm as measured along the deflecting surface region.

7. The dish rack as claimed in claim 1, wherein the deflecting surface region, has an extent of at least 10 mm as measured along the deflecting surface region.

8. The dish rack as claimed in claim 1, wherein there are two of the deflecting surface regions, and as seen in the sectional plane parallel to the standing plane, the two of the deflecting surface regions of the washing liquid deflecting surface are arranged at the obtuse angle relative to an inner surface of the inner wall portion, said inner surface facing the rack interior space, and jointly and directly adjoin the outer wall portion on mutually opposite sides.

9. The dish rack as claimed in claim 1, wherein the washing liquid deflecting surface is inherently curved or inherently angled once or more than once.

10. The dish rack as claimed in claim 1, wherein the washing liquid deflecting surface together with an inner surface facing the rack interior space of the outer wall portion, delimit an indentation in the side wall, said indentation being open in a direction toward the standing plane and in a direction toward the rack interior space.

11. The dish rack as claimed in claim 10, wherein a cross-sectional width of the indentation, said cross-sectional width being measured parallel to the standing plane and parallel to the inner surface of the outer wall portion, increases in the direction toward the rack interior space.

12. An arrangement comprising a dishwasher and the dish rack as claimed in claim 1, wherein the dish rack is arranged in the dishwasher and washing liquid nozzles of the dishwasher are arranged underneath the rack base, and a respective washing liquid dispensing direction of the respective washing liquid nozzle is directed toward the side wall.

13. The arrangement of claim 12, wherein the washing liquid nozzles are arranged in a rotatably mounted washing arm of the dishwasher.

14. A method for washing objects in a dishwasher, the method comprising:

arranging said objects in the rack interior space of the dish rack as claimed in claim 1;

arranging the dish rack above washing liquid nozzles of the dishwasher for washing the objects in the dishwasher; and spraying washing liquid out of the washing liquid nozzles through the side wall and the rack base into the rack interior space, and deflecting some of the washing liquid into the rack interior space by the at least one deflecting surface region which, as seen in the sectional plane parallel to the standing plane, is arranged at the obtuse angle relative to the inner surface of the inner wall portion, with said inner surface facing the rack interior space.

15. The method of claim 14, wherein the washing liquid nozzles are located on a rotatably mounted washing arm of the dishwasher.

* * * * *